US006325118B1

(12) United States Patent
Atkinson

(10) Patent No.: US 6,325,118 B1
(45) Date of Patent: Dec. 4, 2001

(54) WOOD SPLITTER

(75) Inventor: Dana Atkinson, Carson City, NV (US)

(73) Assignee: Askisek Corporation, Bakersfield, CA (US)

( * ) Notice: Subject to any disclaimer, the term of this patent is extended or adjusted under 35 U.S.C. 154(b) by 0 days.

(21) Appl. No.: 09/686,271

(22) Filed: Oct. 10, 2000

(51) Int. Cl.[7] ..... B27L 7/00

(52) U.S. Cl. ..... 144/195.1; 144/193.1; 144/366

(58) Field of Search ..... 144/193.1, 195.1, 144/366

(56) References Cited

U.S. PATENT DOCUMENTS 3,995,672 * 12/1976 Binninger ..... 144/195.1
4,078,591 * 3/1978 Syrjain et al. ..... 144/195.1
4,799,519 * 1/1989 Forbes et al. ..... 144/195.1

* cited by examiner

*Primary Examiner*—W Donald Bray
(74) *Attorney, Agent, or Firm*—Coudert Brothers LLP

(57) ABSTRACT

A wood splitting apparatus has a parting blade and a platen which undergo reciprocating motions in mutually opposite directions by means of a pair of hydraulic cylinders. After the parting blade splits off a portion of a sawn log horizontally, the portion which has been split off is dropped and then pushed by the platen into and through a cutting block provided with a plurality of knives so as to be cut into smaller pieces. The pair of hydraulic cylinders is directly connected by a pipe through which a hydraulic liquid can flow back and forth therebetween and is together controlled by a single valve for power economy. The floor of the cutting block is of an inverted V-shape and the knives are oriented such that the intervals therebetween increase on the downstream side so as to prevent jamming of the apparatus by the wood pieces.

15 Claims, 6 Drawing Sheets

WOOD SPLITTER

BACKGROUND OF THE INVENTION

This invention relates to a wood splitting apparatus (hereinafter referred to as "wood splitter").

Prior art mechanical wood splitting apparatus do not function satisfactorily in that the apparatus is frequently jammed with cut pieces of wood in the spaces between the cutting blades and that the power consumption is relatively high. Another common problem with prior art apparatus has been that they were not sufficiently safe to operate. Injuries to the operator were not infrequent.

It is therefore an object of this invention to provide an improved wood splitting apparatus which can split sawn logs efficiently without becoming jammed frequently.

It is another object of this invention to provide such a wood splitting apparatus which is safe to operate.

It is still another object of this invention to provide such a wood splitting apparatus with a relatively low power consumption rate.

SUMMARY OF THE INVENTION

A wood splitter embodying this invention, with which the above and other desirable objects can be accomplished, may be characterized as operating in two stages, each sawn log piece (the "round") being cut into pieces of an approximately predetermined thickness (say, 3–4 inches) by means of a horizontal parting blade and dropped into a drop chamber below in the first stage and these pieces being pushed forward through a cutting block provided with a plurality of knives with vertically oriented blades to be further cut into smaller pieces in the second stage. Hydraulic cylinders for thrusting the parting blade into the round and a platen serving to push the split wood pieces through the cutting block to be made even smaller are not only controlled by a single valve such that they undergo simultaneous reciprocating motions in mutually opposite directions but also connected directly with a tube such that their hydraulic liquid can pass from one to the other for power efficiency. The floor of the cutting block is of an inverted V-shape, and the knives thereof are oriented such that the intervals between mutually adjacent pairs of them will increase on the downstream side in order to further prevent the jamming of the apparatus.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1A:
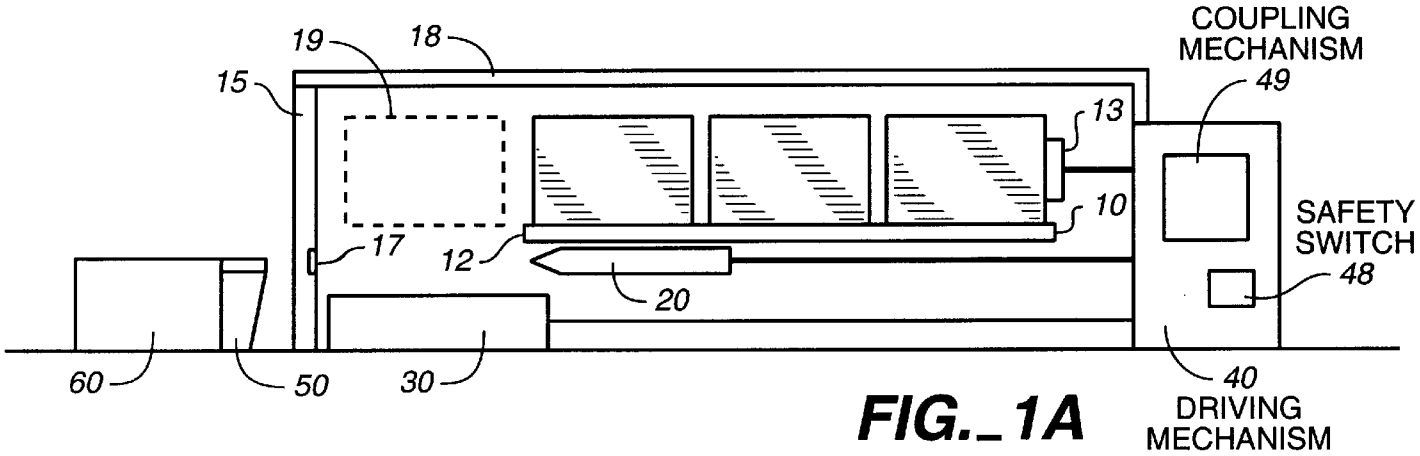
FIGS. 1A, 1B, 1C, 1D and 1E (together referred to as FIG. 1) are schematic drawings showing functional and positional relationships of main components of a wood splitter embodying this invention at various moments in a cycle of its wood splitting operations.

Various aspects of the invention are described next by way of an example with reference to the drawings. FIGS. 1A–1E show schematically major components of a wood splitter embodying this invention as well as their functional and positional relationships at various key moments in a cycle of its wood splitting operations. Sawn log pieces ("rounds") to be split are placed in a row on an elongated feeding table 10, as shown in FIG. 1A. For the convenience of description, the direction in which the feeding table 10 is elongated is hereinafter referred to as the longitudinal direction. One of its edges (referred to as its front edge 12) faces a front wall 15 with a space in between. The rounds aligned on the feeding table 10 are pushed forward by means of a pushing member which is hereinafter referred to as "the advancer 13" and is adapted to move longitudinally forward to cause the foremost one of the aligned rounds to slide off the feeding table 10 over its front edge 12.

Figure 1B:
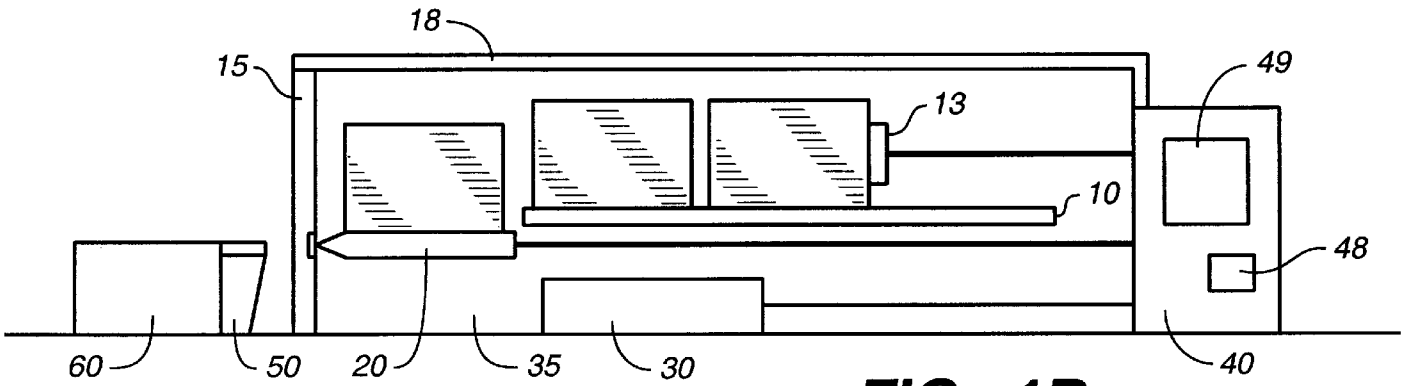
Figure 1C:
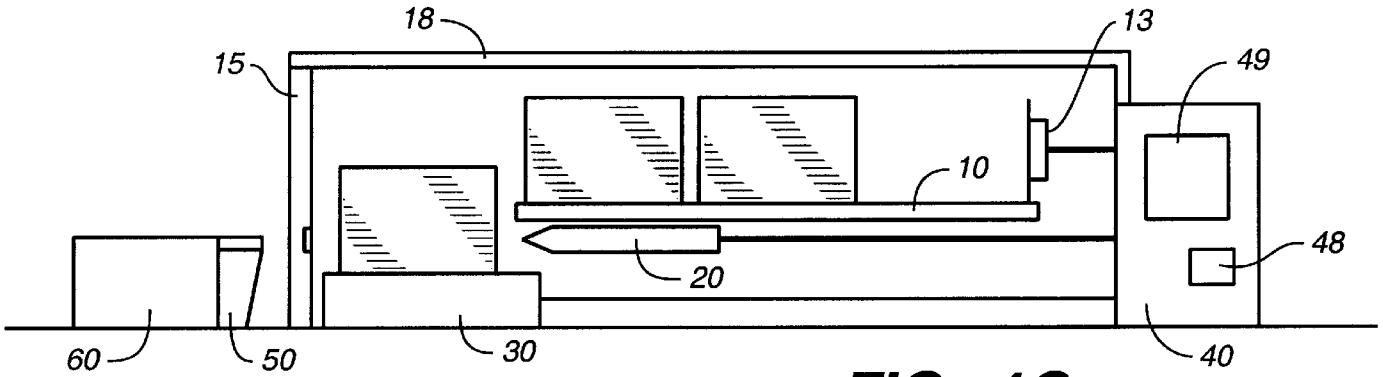
Figure 1D:
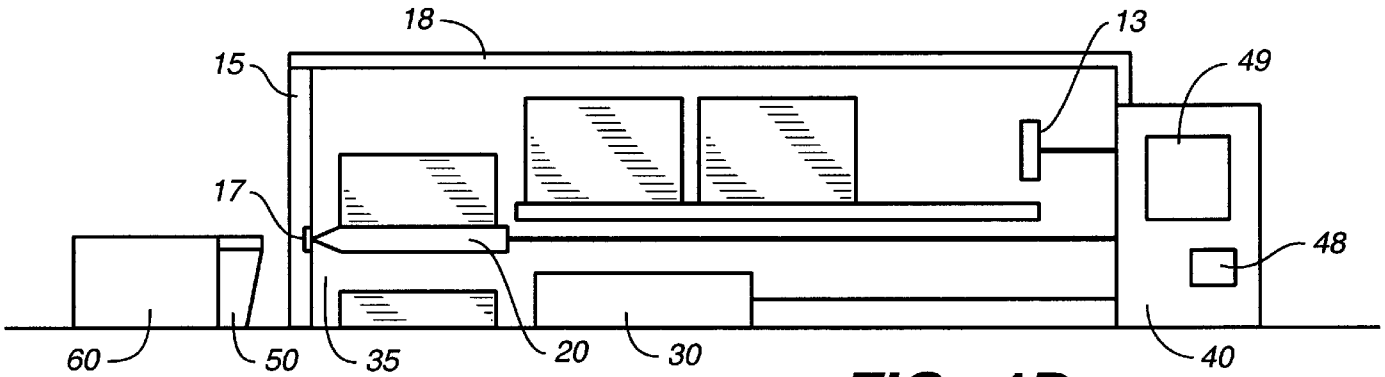
Figure 1E:
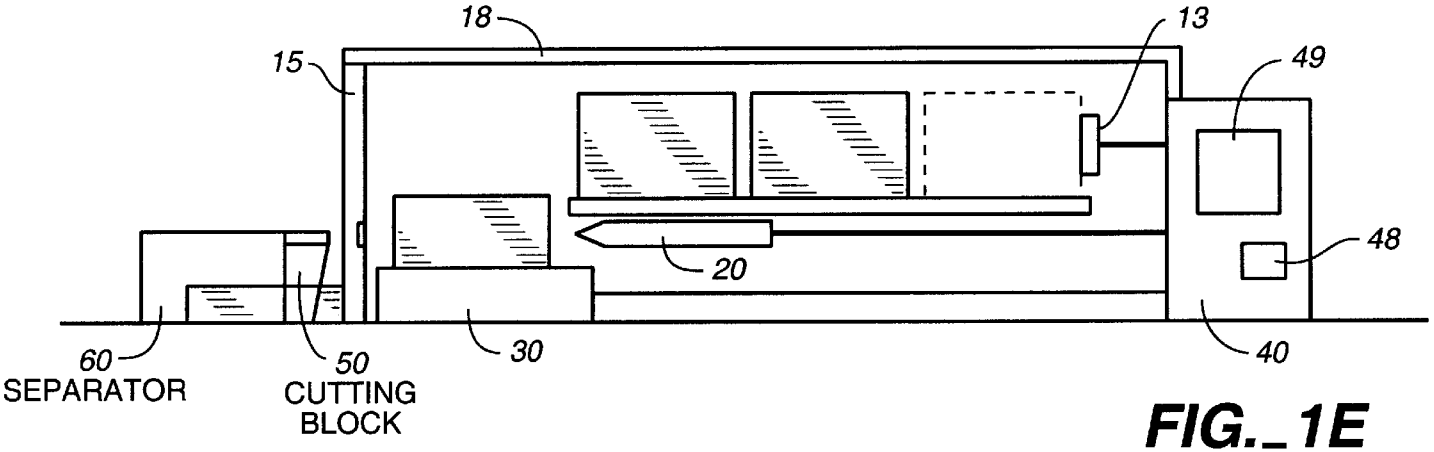
Figure 2A:
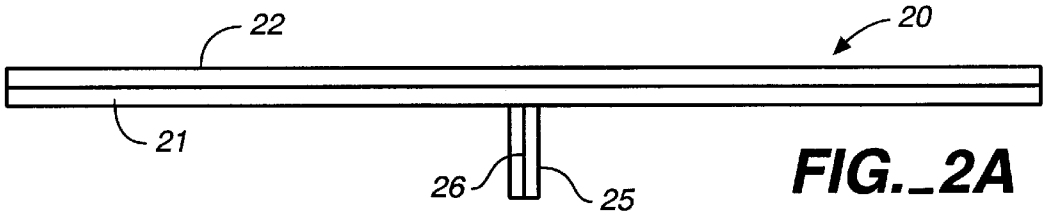
FIG. 2A is a front view and FIG. 2B is a side view of the parting blade shown in FIG. 1.
Figure 2B:
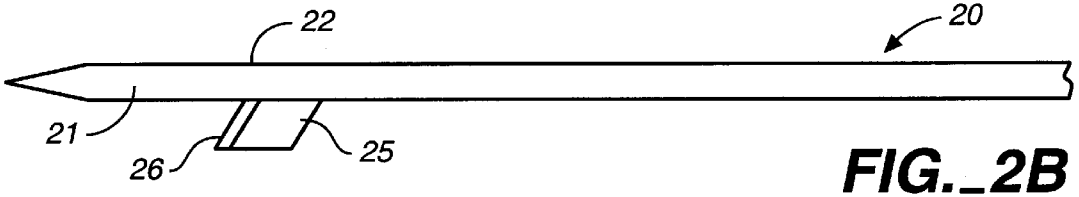

A parting blade 20 for splitting the rounds substantially along a horizontal line is disposed below the feeding table 10, having not only a substantially horizontally extending main part 21 with a planar upper surface 22 but also a vertically downwardly extending part 25 so as to have a generally T-shaped sectional form, as shown in FIGS. 2A and 2B. The parting blade 20 is adapted to move longitudinally and reciprocatingly between a forward position, as shown in FIGS. 1B and 1D, and a backward position, as shown in FIGS. 1A, 1C and 1E) by means of a hydraulic cylinder (which is not shown in FIG. 1 but is a part of a driving mechanism shown in FIG. 1 at 40 and will be described in detail below). When the parting blade 20 is in the forward position, it substantially entirely occupies the space between the front edge 12 of the feeding table 10 and the front wall 15. When the parting blade 20 is in the backward position, it is completely retracted from this space.

Although shown only schematically in FIG. 1, there is a coupling mechanism 49, which is also a part of the driving mechanism 40, for coupling and decoupling the motions of the advancer 13 and the parting blade 20. At the beginning of a wood splitting cycle, their motions are coupled. Thus, as a round on the feeding table 10 is pushed forward by the advancer 13 and the foremost one of them is caused to slide off the front edge 12 as described above, the parting blade 20 is also moving forward at the same rate and catches the round on the planar upper surface 22 of its horizontal part 21, as shown in FIG. 1B.

The space below the parting blade 20 is hereinafter referred to as the drop chamber 35 containing therein a platen 30 which is also longitudinally movable by means of another hydraulic cylinder (not shown in FIG. 1 but a part of the same driving mechanism 40) between the forward position which is between the front edge 12 of the feeding table 10 and the front wall 15 and the backward position retracted backward completely therefrom. The aforementioned two hydraulic cylinders associated individually with the parting blade 20 and the platen 30 are controlled by the driving mechanism 40, as will be described in detail below, so as to undergo simultaneous reciprocating motions in mutually opposite directions.

After the round comes to rest on the parting blade 20, as shown in FIG. 1B, the driving mechanism 40 causes the parting blade 20 to move backward to the backward position and the platen 30 to simultaneously move forward. Since the round is prevented by the front edge 12 of the feeding table 10 from remaining on the parting blade 20 and moving backward therewith, it remains in the forward position between the front edge 12 of the feeding table 10 and the front wall 15, dropping down onto the platen 30 which comes into the forward position, as shown in FIG. 1C.

Next, the driving mechanism 40 moves the parting blade 20 and the platen 30 by reversing the directions of their motions after the aforementioned coupling mechanism 49 is operated to decouple their motions. Before the platen 40 is pulled backward completely under the round, however, the parting blade 20 reaches the round, pushes it forward towards the front wall 15, presses it against it and begins to split it horizontally by its horizontal main part 21. The difference in height between the parting blade 20 and the upper surface of the platen 30 thus determines the thickness to which the round is to be horizontally cut. In other words, this height difference is determined according to the size of wood pieces desired to be obtained.

Figure 3:
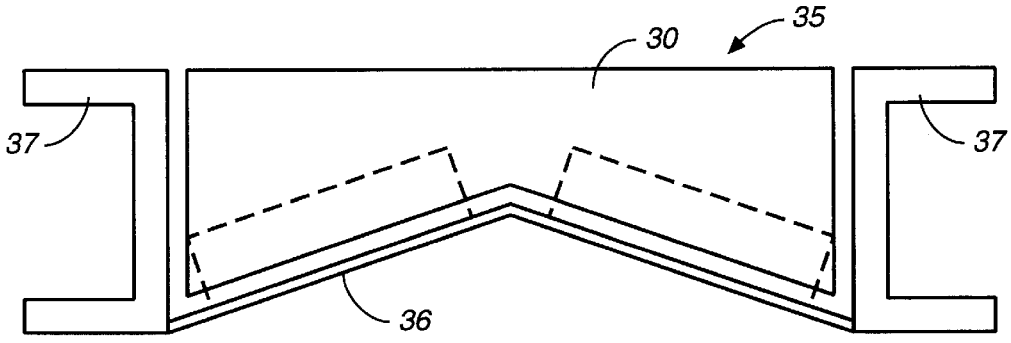
FIG. 3 is a schematic longitudinal view of the drop chamber shown in FIG. 1.

As shown in FIG. 2B, the parting blade 20 has a vertically extending part 25 with a front blade 26 obliquely oriented from the vertical direction. As the round is cut horizontally as explained above, the cut piece is thereby also split vertically. The obliqueness of the front edge 26 tends to push the horizontally cut piece upward, making it easier for the piece to be split vertically. The portions of the round thus cut into pieces drop into the drop chamber 35, while the rest of the round remains on the upper surface 22 of the main part 21 of the parting blade 20, as shown in FIG. 1D. It is to be noted that the advancer 13 remains in the backward position in the meantime, decoupled from the parting blade 20 by means of the coupling mechanism 49 and hence not participating in the forward movement of the latter. As shown in FIG. 3, the drop chamber 35 has a floor 36 which is of an inverted V-shape when seen longitudinally, having two equally sloped planes with an angle of slope equal to about 15–20° extending between a pair of channels 37 such that the vertically split pieces dropped thereon tend to move away from each other, as indicated by broken lines in FIG. 3.

On the front wall 15 where the horizontally extending main part 21 of the parting blade 20 comes into contact as shown in FIG. 1D, there is provided a metal member 17 for contacting the parting blade 20 such that rounds can be cut thereby "to the last fiber". In order to prevent the parting blade 20 from becoming dull too quickly from the frequent contacting with this metal member 17, a material softer than that of the parting blade 20 is used for this metal member 17. The parting blade 20 is typically made of a high carbon steel alloy, and aluminum, brass or aluminum bronze may be effectively used for the metal member 17.

Next, the directions of motions of the parting blade 20 and the platen 30 are reversed again, the parting blade 20 being retracted into the backward position while the platen 30 is moved forward to the forward position. The remaining portion of the round, which was on the parting blade 20, thereby ends up by sitting on top of the platen 30 while the split off pieces dropped into the drop chamber 35 are pushed forward through the front wall 15, a cutting block 50 disposed outside and in front of the front wall 15, and a separator 60 to be described below, as shown in FIG. 1E.

The cutting block 50 is a device for further splitting the pieces dropped into the drop chamber 35 as described above, comprising a plurality (four in the example shown in FIG. 4A) of knife blades 52 supported between a frame structure 53 and a floor 55 which is of the same inverted V-shape as that of the floor 36 of the drop chamber 35. As shown in FIG. 3, the bottom of the platen 30 is accordingly V-shaped such that the cut pieces of the round dropped onto the floor 36 of the drop chamber 35 can be efficiently pushed forward by the platen 30 not only into the cutting block 50 but also inside the cutting block 50 through these knife blades 52.

Figure 4A:
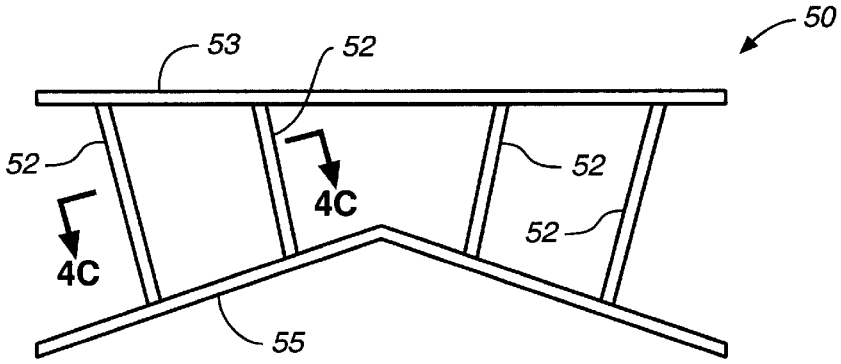
FIG. 4A is a schematic longitudinal view of the cutting block.
Figure 4B:
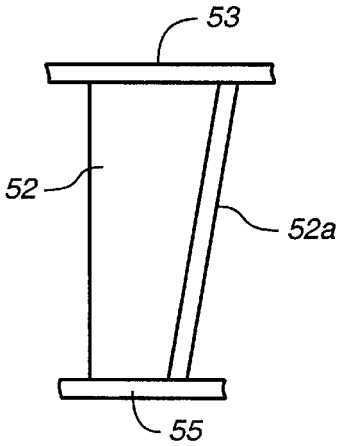
FIG. 4B is a side view of one of its knife blades and FIG. 4C is a sectional view taken long line 4C—4C of FIG. 4A.
Figure 4C:
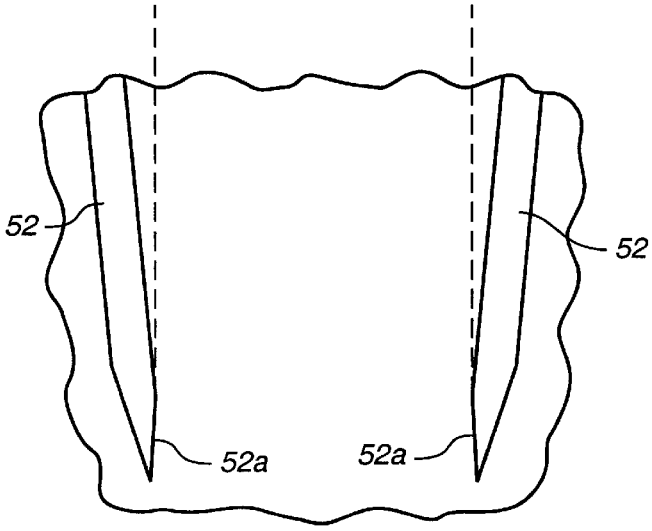
Figure 5:
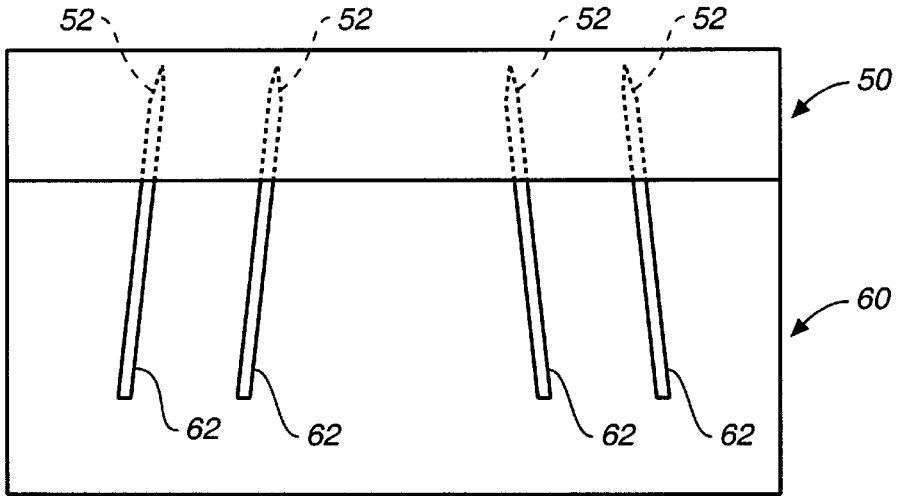
FIG. 5 is a schematic top view of the separator indicated in FIG. 1.

Each of the knife blades 52 is oriented substantially perpendicularly to the part of the floor 55 to which it is affixed, as shown in FIG. 4A. Seen sideways, as shown in FIG. 4B, each knife blade 52 has an inclined edge line 52*a* such that the wood piece which is pushed against it tends to be pushed downward towards the surface of the floor 54 for efficient splitting. The angle of inclination from the vertical may preferably be about 14°. Seen sectionally, as shown in FIG. 4C in an exaggerated fashion, a mutually adjacent pair of these knife blades 52 is oriented such that the separation therebetween increases on the downstream side as the pieces of wood being cut thereby advances although their front edge parts 52*a* are parallel to each other (as emphasized by broken lines). The angle at which the pair of mutually adjacent knife blades 52 extend may be typically about 4–5°. It is also to be noted in FIG. 4A that the cutting block 50 does not have any side walls. The absence of side walls, the outwardly downsloping floor 55 and orientational relationships among the knife blades 52 all contribute to reduce the possibility of jamming.

Although shown only schematically in FIG. 1, a device herein referred to as the separator 60 is disposed behind, or on the downstream side of, the cutting block 50 with reference to the direction of motion of the wood pieces pushed by the platen 30 therethrough. The separator 60 consists principally of partitions 62 which are elongated members of length equal to about one half of the length of the wood pieces passing through the cutting block 50, extending in the directions of the knife blades 52. The purpose of the separator 60 is to further keep the wood pieces split by these knife blades 52 while being pushed forward by the platen 30 to remain separated and not to jam the cutting block 50, and also to remove barks and chips, as well as dirt from the wood pieces before they are discharged.

From the moment depicted in FIG. 1E, the driving mechanism 40 causes the parting blade 20 and the platen 30 to repeat their mutually opposite reciprocating motions described above with reference to FIGS. 1D and 1E. For each round trip by the parting blade 20, the round resting on the platen 30 is split horizontally, the split portions dropping into the drop chamber 35 and being pushed through the cutting block 50 and the separator 60 to be discharged by the forward motion of the platen 30, as described above. During this time, the coupling mechanism 49 is controlled such that the parting blade 20 and the advancer 13 are decoupled, the advancer 13 remaining at the backward position as shown in FIGS. 1C, 1D and 1E. A new round may be placed on the feeding table 10 in the meantime, as indicated by broken lines in FIG. 1E.

Figure 6:
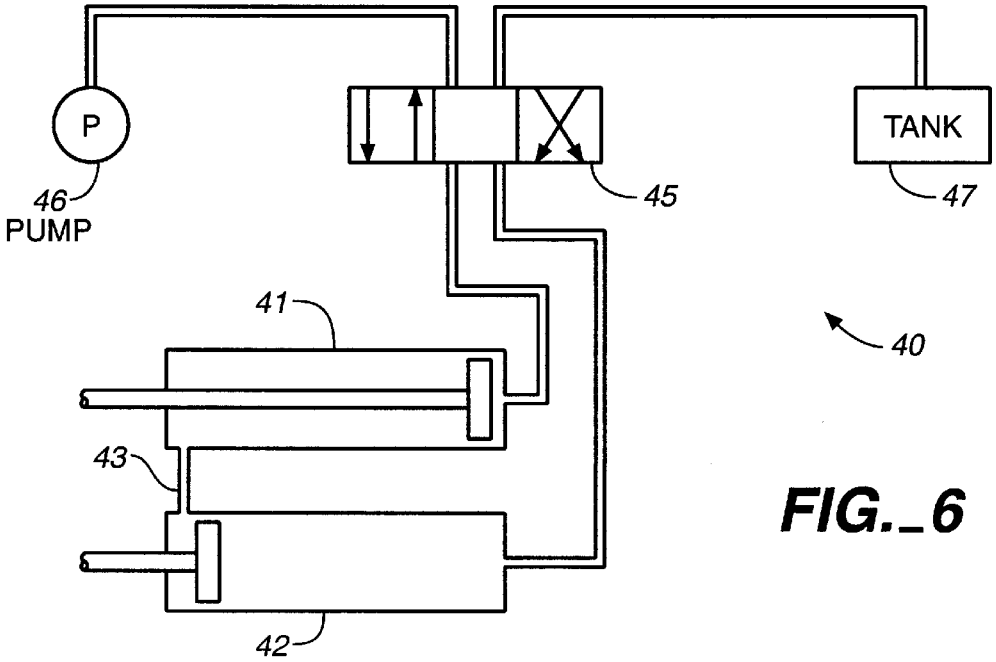
FIG. 6 is a schematic block diagram of a portion of the driving mechanism related to the operation of hydraulic cylinders for the parting blade and the platen shown in FIG. 1.

As schematically shown in FIG. 6, the driving mechanism 40 for causing the parting blade 20 and the platen 30 to undergo reciprocating motions in mutually opposite directions includes a pair of hydraulic cylinders which will be hereinafter referred to as the first cylinder 41 and the second cylinder 42 respectively for moving the parting blade 20 and the platen 30, and these two cylinders 41 and 42 are connected to and controlled by a single four-way valve 45 of a known kind which is also connected to a pump 46 and a tank 47 for the hydraulic liquid which is circulated into the cylinders 41 and 42. In addition, these cylinders 41 and 42 are directly connected through a pipe 43 which connects to each of the cylinders 41 and 42 on the opposite side of the piston from where the connection is made to the valve 45. Let us assume that FIG. 6 shows a moment at which the parting blade 20 is at the backward position and the platen 30 is at the forward position, such as shown in FIGS. 1A, 1C and 1E, the piston of the first cylinder 41 being at the right-hand end of the cylinder and the piston of the second cylinder 42 being at the left-hand end of the cylinder (as shown in FIG. 6). When the parting blade 20 is to be moved to the forward position and the platen 30 simultaneously from the forward position to the backward position, the valve 45 is switched such that the hydraulic pressure from the pump 46 is communicated to the first cylinder 41, the hydraulic fluid flowing through the valve 45 into the first cylinder 41 and thereby causing its piston to move to the left (with reference to FIG. 6). The hydraulic liquid on the left-hand side of the piston is pressured into the second cylinder 42 through the connecting pipe 43. It is to be noted that the pipe 43 connects the two cylinders 41 and 42 directly, in the sense that there is no valve or other flow-control device inserted therein. As the hydraulic liquid from the first cylinder 41 flows into the left-hand side of the piston of the second cylinder 42, the piston of the second cylinder 42 moves to the right, pushing the hydraulic liquid which was on the right-hand side of the piston of the second cylinder 42 through the valve 45 into the tank 47. When the platen 30 is moved from the backward position to the forward position and the parting blade 20 simultaneously from the forward position to the backward position, the valve 45 is switched such that the pressure from the pump will be communicated to the second cylinder 42 and the hydraulic liquid which was on the left-hand side of the piston of the second cylinder 42 is pushed through the pipe 43 back into the left-hand side of the piston of the first cylinder 41.

The wood splitter embodying this invention is further characterized as having a housing 18, of which the aforementioned front wall 15 may be considered a part, as an important safety feature. The housing 18 may be of sheet metal and/or expanded metal, installed on top and at least around the parting blade 20, the wood-feeding mechanism including the advancer 13, and the drop chamber 35. There is an opening for loading the rounds and an access door (shown by broken lines at 19 in FIG. 1A only), say, for cleaning. The driving mechanism 40 includes a safety switch 48 serving to stop the operation of the driving mechanism 40 when the door is detected to be open while the driving mechanism 40 is in operation, or while the wood splitter is under a specified operational condition requiring the door 19 to be closed for safety.

Figure 7:
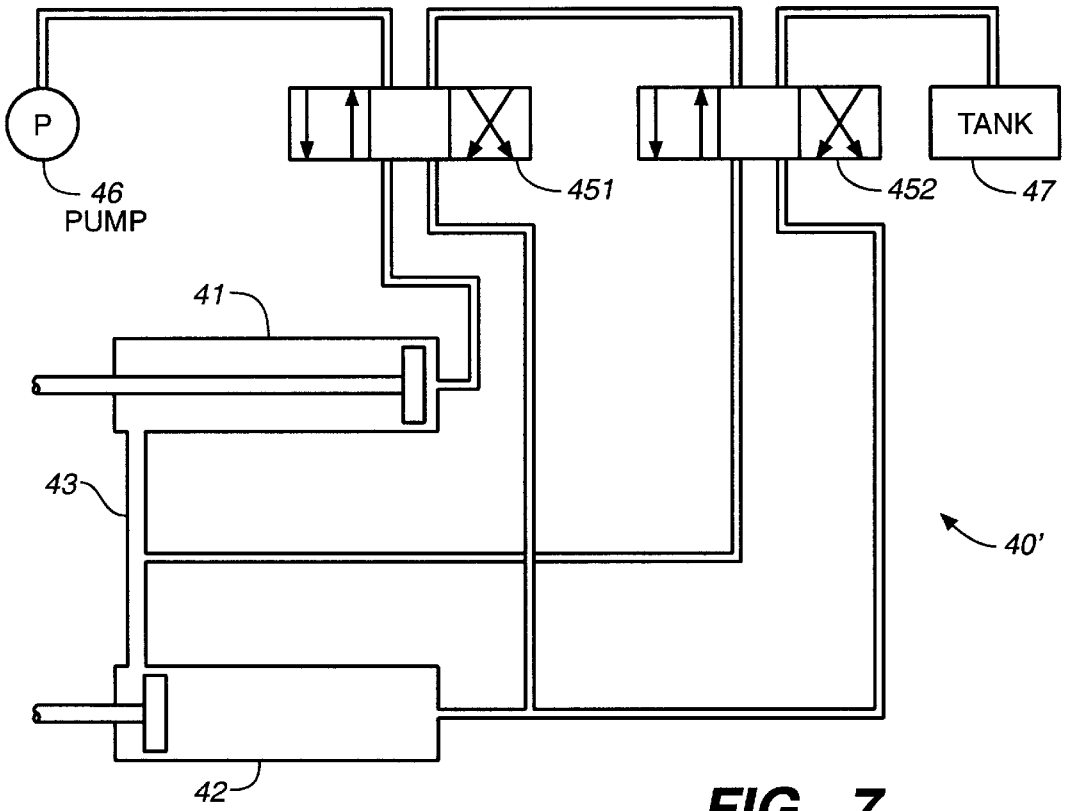
FIG. 7 is a schematic block diagram of a portion of another driving mechanism which may be used in place of the mechanism shown in FIG. 6.

The invention has been described above with reference to only one example. This example, however, is not intended to limit the scope of the invention because many modifications and variations are possible within the scope of the invention. For example, the two hydraulic valves 41 and 42 respectively for the movement of the parting blade 20 and the platen 30 need not be controlled by a single valve 45 all the time. FIG. 7 shows another driving mechanism 40' adapted to be capable of alternatively driving only the second hydraulic cylinder 42 for causing the platen 40 to undergo its reciprocating motion while the parting blade 20 is kept stationary. This mode of operation is useful when there are relatively small rounds which can be split directly by means of the cutting block 50 without first being cut by means of the parting blade 20. In other words, the operator can drop in such a small round directly by hand into the drop chamber 35 while the parting blade 20 is kept stationary at its backward position and thereafter operating only the second hydraulic cylinder 42 to push the round forward into the cutting block 50.

For this purpose, the driving mechanism 40' according to this alternative embodiment of the invention includes two four-way valves connected in series between a pump 46 and a tank 47 ("the first valve 451" closer to the pump 46 and "the second valve 452" closer to the tank 47). The first valve 451 is connected to the two cylinders 41 and 42 as the unique valve 45 shown FIG. 6 but two of the ports of the second valve 452 are individually connected to the second cylinder 42 and the pipe 43 between the two cylinders 41 and 42. When it is desired to drive both of the cylinders 41 and 42 together in mutually opposite directions, the second valve 452 is switched such that the hydraulic liquid will move directly between the first valve 451 and the tank 47, the first valve 451 functioning to push the pistons of both of the cylinders 41 and 42 back and forth, as explained above with reference to FIG. 6. When it is desired to keep the parting blade 20 stationary and drive only the second cylinder 42 for reciprocatingly moving only the platen 30, the first valve 451 is switched such that the hydraulic liquid will move directly between the pump 46 and the second valve, the second valve 42 functioning to push the piston of only the second valve 42. It should be noted that the piston of the first cylinder 41 remains pushed to the right-hand side (referred to FIG. 7) in this mode of operation, keeping the parting blade 20 at its backward position such that the operator is free to drop in a round into the drop chamber 35, as explained above. In this mode of operation, furthermore, the aforementioned safety switch 48 may be set up so as to allow the operation of the driving mechanism 40' only if both the parting blade 20 and the platen 30 are at the backward position.

Thus, the description herein is intended to be interpreted broadly. The figures, said to be schematic, are indeed intended to be schematic, not necessarily representing desired dimensional relationships of the various components or shapes. Among the important inventive elements characterizing the present invention are the reciprocating motions of the parting blade and the platen, the cutting of a round in two stages, first by the parting blade and second by being pushed through the cutting block, the use of a cross-sectionally T-shaped parting blade, the floors with an inverted V-shape for the drop chamber and the cutting block as well as the mutual orientations of the knife blades of the cutting block designed so as to prevent the jamming of the apparatus, and a pair of hydraulic cylinders which are directly connected with each other by a pipe and controlled by a single valve for power economy. Additional inventive elements of the present invention include the absence of side walls in the cutting block and the use of a separator to further prevent the jamming of the apparatus.

A prototype embodying the invention has proved to accomplish the aforementioned objects of the invention more than satisfactorily. This is in contrast to many patented wood splitters which failed to function well enough to be commercialized.

In summary, all modifications and variations on the disclosures made herein that may be apparent to a person skilled in the art are intended to be within the scope of this invention.

What is claimed is:

1. A wood splitter comprising:

a longitudinally extending feeding table having a front edge;

a front wall in front of said feeding table;

a parting blade for splitting wood pieces, said parting blade being movable longitudinally towards said front wall to a forward position and away from said front wall to a backward position;

an advancer for pushing wood pieces disposed on said feeding table to slide off said front edge one at a time onto said parting blade when said parting blade is at said forward position;

a platen which is movable inside a drop chamber below said parting blade;

driving means for moving said parting blade and said platen longitudinally in opposite directions such that when said parting blade is at said forward and backward positions said platen is respectively at said backward position and said forward position, said front wall and said front edge serving to cause the wood piece on said parting blade to drop onto said platen when said driving means moves said parting blade to said backward position and said platen simultaneously to said forward position, said driving means further serving to move said parting blade to said forward position and said platen simultaneously to said backward position while the wood piece is supported on said platen, thereby causing portions of the wood piece to be split off by said parting blade and dropping the split-off portions into said drop chamber in front of said platen at said backward position; and a cutting block disposed in front of said drop chamber, said platen further serving to push the split-off portions in said drop chamber through said cutting block to be cut into smaller pieces by moving from said backward position to said forward position.

2. The wood splitter of claim 1 wherein said parting blade includes substantially horizontal blade part and a vertical blade part, being sectionally T-shape as seen longitudinally.

3. The wood splitter of claim 2 wherein said vertical blade part has a tilted front edge.

4. The wood splitter of claim 1 further comprising coupling means for coupling said parting blade and said advancer so as to move together and decoupling said parting blade and said advancer so as to allow said advancer to remain stationary while said parting blade is moved by said driving means.

5. The wood splitter of claim 1 wherein said front wall has thereon a metallic member where said parting blade comes into contact with said front wall as said parting blade is moved to said forward position to split the wood piece, said metallic member being softer than said parting blade.

6. The wood splitter of claim 1 wherein said driving means includes a pair of hydraulic cylinders individually connected to said parting blade and said platen, a single valve which controls motion of a hydraulic liquid to and from said pair of hydraulic cylinders such that said parting blade and said platen will move simultaneously and in mutually opposite directions, and a pipe which directly connects said pair of cylinders and through which said hydraulic liquid flows from one to the other of said cylinders each time said cylinders are operated to move said parting blade in one direction and said platen in the opposite direction.

7. The wood splitter of claim 1 wherein said cutting block and said drop chamber have a floor which is of an inverted V shape as seen longitudinally, having an elevated center part between a pair of sloped parts becoming lower outwardly with a sloping angle of 15–20°.

8. The wood splitter of claim 1 wherein said cutting block comprises a plurality of knives disposed at intervals and oriented such that said intervals increase as the split-off portions are pushed through said cutting block.

9. The wood splitter of claim 8 wherein said knives have blades which are sloped such that the split-off portions are pressed downwards by coming into contact therewith while being cut thereby.

10. The wood splitter of claim 1 further comprising a separator having partitions, disposed downstream to said cutting block and serving to separate unwanted barks, chips and dirt and to keep the split wood pieces separated.

11. The wood splitter of claim 1 wherein said driving means selectably functions in an alternative mode of operations in which said platen is caused to move reciprocatingly between said forward position and said backward position while said parting blade is kept stationary.

12. The wood splitter of claim 11 wherein said driving means includes:

a pair of hydraulic cylinders individually connected to said parting blade and said platen;

a first valve which controls motion of a hydraulic liquid to and from said pair of hydraulic cylinders such that said parting blade and said platen will move simultaneously and in mutually opposite directions;

a pipe which directly connects said pair of cylinders and through which said hydraulic liquid flows from one to the other of said cylinders each time said cylinders are operated to move said parting blade in one direction and said platen in the opposite direction; and a second valve which controls motion of said hydraulic liquid directly to and from one of said pair of hydraulic cylinders connected to said platen without passing through the other of said pair of hydraulic cylinders.

13. The wood splitter of claim 12 wherein said first valve and said second valve are each a four-way valve and are connected in series between a pump and a tank for said hydraulic liquid.

14. The wood splitter of claim 1 further comprising a housing which contains therein at least said parting blade, said advancer and said platen.

15. The wood splitter of claim 14 wherein said housing has an access door and said driving means includes a safety switch which serves to stop operations of said driving means if said door is detected to be open while said wood splitter is under a specified operational condition.

* * * * *